US011221147B2

(12) United States Patent
Silverman

(10) Patent No.: US 11,221,147 B2
(45) Date of Patent: Jan. 11, 2022

(54) COLLAPSIBLE RADIATIVE HEATER ASSEMBLY AND METHODS FOR ASSEMBLY AND USE

(71) Applicant: P.R.E. Sales Inc., San Diego, CA (US)

(72) Inventor: Philip Silverman, San Diego, CA (US)

(73) Assignee: P.R.E. Sales Inc., San Diego, CA (US)

( * ) Notice: Subject to any disclaimer, the term of this patent is extended or adjusted under 35 U.S.C. 154(b) by 176 days.

(21) Appl. No.: 16/431,481

(22) Filed: Jun. 4, 2019

(65) Prior Publication Data

US 2020/0386412 A1 Dec. 10, 2020

(51) Int. Cl.
*F24C 15/08* (2006.01)
*F24C 15/22* (2006.01)
*F24C 1/12* (2006.01)

(52) U.S. Cl.
CPC ..... *F24C 15/08* (2013.01); *F24C 1/12* (2013.01); *F24C 15/22* (2013.01)

(58) Field of Classification Search
CPC .. F24C 15/08; F24C 15/22; F24C 1/12; F24C 15/16; F24C 3/14; A47B 37/04
USPC ..... 248/534
See application file for complete search history.

(56) References Cited

U.S. PATENT DOCUMENTS 2,141,742 A * 12/1938 Ehret ..... F16M 11/28 219/392
2,143,411 A * 1/1939 Ehret ..... F16M 11/18 254/100
3,167,292 A * 1/1965 Meyerowitz ..... A47B 96/06 248/230.1
4,576,501 A * 3/1986 McConnell ..... F16B 7/1472 248/413
5,311,813 A * 5/1994 Fairbanks ..... A47J 47/005 135/126
5,474,185 A * 12/1995 Franke ..... B65D 65/02 206/586
5,727,477 A * 3/1998 Kirkendall ..... A47B 13/086 108/90
6,056,254 A * 5/2000 Albright ..... F16B 7/0406 223/120
6,178,979 B1 * 1/2001 Galloway ..... A47B 37/04 108/50.12
6,302,124 B1 * 10/2001 Demarco ..... A45B 1/00 135/15.1
6,336,450 B1 * 1/2002 Collet ..... F24C 1/12 126/92 B (Continued)

FOREIGN PATENT DOCUMENTS

DE 202011051175 U1 * 11/2011 ..... F24C 3/14
DE 102013208704 A1 * 11/2014 ..... F16M 11/28
WO WO-2004023954 A1 * 3/2004 ..... A47J 37/0709

*Primary Examiner* — Jorge A Pereiro
(74) *Attorney, Agent, or Firm* — Troutman Pepper Hamilton Sanders LLP

(57) ABSTRACT

A collapsible radiative heater assembly is disclosed that may be configured to save space and protect sensitive mechanisms of the heater. The collapsible heater may include a burner unit, a body and a hollow collapsible neck. The body may further comprise a receiving device that includes a first locking mechanism and a second locking mechanism for the hollow collapsible neck. The assembly may also include a protective casing that is attached detachably to the body in order to protect components of the assembly during transport or storage.

20 Claims, 9 Drawing Sheets

(56) References Cited

U.S. PATENT DOCUMENTS 6,345,794 B1 * 2/2002 Varner ..... A47F 8/00 223/68
6,347,777 B1 * 2/2002 Webber ..... A47C 7/402 248/188.5
6,397,835 B1 * 6/2002 Liang ..... F21L 19/00 126/92 B
6,470,877 B1 10/2002 Waters
6,499,411 B2 * 12/2002 Brown ..... E04H 15/02 108/26
6,722,810 B1 * 4/2004 Tachikawa ..... F16D 3/06 403/362
7,156,357 B1 * 1/2007 Kocur ..... E04H 12/2215 248/231.9
7,726,681 B2 * 6/2010 McKendry ..... B60D 1/52 280/506
7,780,139 B2 * 8/2010 Markert ..... E04H 12/2261 248/523
D627,450 S * 11/2010 Hall, Jr. ..... D23/332
D627,451 S * 11/2010 Hall, Jr. ..... D23/332
8,068,726 B2 11/2011 Saunders et al.
8,434,802 B2 * 5/2013 Lofley, Sr. ..... B25G 1/04 294/210
8,469,425 B1 * 6/2013 Lofley, Sr. ..... B25G 1/04 294/210
8,899,253 B1 * 12/2014 Watson ..... E04H 15/02 135/125
9,200,655 B2 * 12/2015 Pan ..... F16B 9/023
9,388,600 B2 * 7/2016 Leathers ..... A47B 97/00
10,030,889 B2 7/2018 Merritt
2002/0023636 A1 * 2/2002 Ashton ..... F21V 3/00 126/92 B
2003/0029439 A1 * 2/2003 Bossler ..... F24C 1/10 126/92 B
2003/0049579 A1 * 3/2003 Hsieh ..... F23D 14/28 431/344
2003/0056782 A1 * 3/2003 Liang ..... F24C 1/12 126/92 B
2004/0177843 A1 * 9/2004 Bernini ..... F24C 1/12 126/92 AC
2007/0107170 A1 * 5/2007 Killip ..... F16B 2/065 24/346
2008/0152329 A1 * 6/2008 Saunders ..... F24C 7/065 392/407
2009/0053664 A1 * 2/2009 Staller ..... F23C 13/08 431/328
2009/0223512 A1 * 9/2009 Konkle ..... F24C 1/10 126/92 AC
2010/0065047 A1 * 3/2010 Wang ..... F23D 14/145 126/92 AC
2013/0239943 A1 * 9/2013 James ..... F16B 9/056 126/58
2014/0041556 A1 * 2/2014 Diepenbrock ..... A47B 13/088 108/50.13
2014/0220293 A1 * 8/2014 Lavigna ..... F24C 15/06 428/100
2016/0088909 A1 * 3/2016 Eddy ..... E04H 12/2261 248/518
2016/0138828 A1 * 5/2016 Merritt ..... F24H 9/06 126/72
2016/0183702 A1 * 6/2016 Elze ..... A47G 11/003 297/219.1
2016/0348915 A1 * 12/2016 Yang ..... F24C 3/042
2017/0122354 A1 * 5/2017 Guerra ..... F16B 9/02
2018/0008094 A1 * 1/2018 Mackinder ..... A47J 37/0786
2018/0180291 A1 * 6/2018 Wei ..... F24C 1/12

* cited by examiner

COLLAPSIBLE RADIATIVE HEATER ASSEMBLY AND METHODS FOR ASSEMBLY AND USE

FIELD OF THE TECHNOLOGY

The presently disclosed subject matter generally relates to an improved radiative heater assembly and associated methods for assembly and use, and more specifically, to a collapsible radiative heater assembly suitable for transport and storage.

BACKGROUND

Radiative heaters, for example, patio heaters, are useful for heating areas where it is economically or practically infeasible to construct permanent heaters, for example, radiators or central heating systems. Conventional radiative heater generally comprise a burner unit placed on top of a neck, which is typically assembled on a base that contains a fuel source.

Restaurants may own many radiative heaters to provide comfort for their guests during the cold winter months or for chilly summer nights. However, the restaurant may store them in a storage room during the summer months or when they are not required. Due to irregular and unconfigurable form factor of such heaters, such storage can be challenging often resulting in inconvenience and increased expenses for the restaurants. Accordingly, it would be advantageous to have a radiative heater assembly that is capable of being stored more easily and efficiently.

Another challenge associated with conventional radiative heaters is the risk of damaging the radiative heaters in transport. For example, an event services (or rental) company may transport the radiative heaters to a location for use. If the heater is damaged in transport, it may become inoperable or operate incorrectly. Replacing or repairing damaged equipment is not only expensive but using damaged equipment may lead to serious harm that can result in the loss of life or property. Therefore, it would be advantageous to have a radiative heater assembly having increased durability.

Accordingly, there is a need for improved radiative heater assemblies and associated methods for assembly and use. Embodiments of the present disclosure are directed to this and other considerations.

SUMMARY

Aspects of the disclosed technology are directed to an improved radiative heater assembly, or system, and to improved methods for using and/or assembling such systems.

In some examples, a collapsible radiative heater assembly is disclosed. The collapsible radiative heater assembly may include a burner unit, a hollow collapsible neck and a base. The base can include at least a body, a receiving device attached to the upper surface of the body. The receiving device can include first locking mechanism and a second locking mechanism for securing the vertical position of the hollow collapsible neck. The burner unit can include least a heat disbursing head and a reflector attached detachably to the heat disbursing head. The hollow collapsible neck can have first end that is insertable into the receiving device and a second end to which the heat distributing head is mounted.

In some examples, a collapsible radiative heater assembly is disclosed. The collapsible radiative heater assembly may include a burner unit, a hollow collapsible neck and a base. The base can include at least a body, and a receiving device attached to the upper surface of the body. The body can include cavity to receive a fuel source. The receiving device can include first locking mechanism, a second locking mechanism and a receiving portion. The vertical position of the hollow collapsible neck may be secured by at least the first or second locking mechanisms. The hollow collapsible neck can have first end that is insertable into the receiving portion of the receiving device, and a second end. The hollow collapsible neck being moveable about a central vertical axis of the receiving device.

The hollow collapsible neck includes an aperture and at least one of the first and second locking mechanisms comprises a fastener configured to be inserted into the aperture of the hollow collapsible neck. The base further includes a table top that is secured around the hollow collapsible neck and located between the first end and the second end of the hollow collapsible neck, the table top further includes an attachment mechanism and is secured to the base. The collapsible radiative heater assembly can include heat disbursing head mounted to the second end of the hollow collapsible neck to generate heat, via an ignition system, a reflector detachably mounted to the heat disbursing head and a protective cover that is secured to the table top by the attachment mechanism. The cover slides over the heat disbursing head and attaches to the attachment mechanism when the reflector is detached, and the hollow collapsible neck is fully inserted into the receiving device.

In some examples, a collapsible radiative heater assembly is disclosed. The collapsible radiative heater assembly may include a burner unit, a hollow collapsible neck and a base. The base can include at least a body, a receiving device attached to the upper surface of the body, and a cover attachment mechanism. The body can include cavity to receive a fuel source. The receiving device can include first locking mechanism, a second locking mechanism and a receiving portion. The vertical position of the hollow collapsible neck may be secured by at least the first or second locking mechanisms. The hollow collapsible neck can have first end that is insertable into the receiving portion of the receiving device, and a second end. The hollow collapsible neck being moveable about a central vertical axis of the receiving device. The base further includes a table top that is secured around the hollow collapsible neck and located between the first end and the second end of the hollow collapsible neck, the table top further includes a cover attachment mechanism and is secured to the base. The collapsible radiative heater assembly can include heat disbursing head mounted to the second end of the hollow collapsible neck to generate heat, a reflector detachably mounted to the heat disbursing head and a protective cover that is secured to the table top by the cover attachment mechanism. The cover slides over the heat disbursing head and attaches to the cover attachment mechanism when the reflector is detached, and the hollow collapsible neck is fully inserted into the receiving device. The heat disbursing head includes an ignition system configured to ignite fuel from the fuel source for generating heat.

Further features of the disclosed design, and the advantages offered thereby, are explained in greater detail hereinafter with reference to specific embodiments illustrated in the accompanying drawings, wherein like elements are indicated be like reference designators.

BRIEF DESCRIPTION OF THE DRAWINGS

Reference will now be made to the accompanying drawings, which are not necessarily drawn to scale, and which are incorporated into and constitute a portion of this disclosure, illustrate various implementations and aspects of the disclosed technology and, together with the description, serve to explain the principles of the disclosed technology. In the drawings.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION

Figure 1:
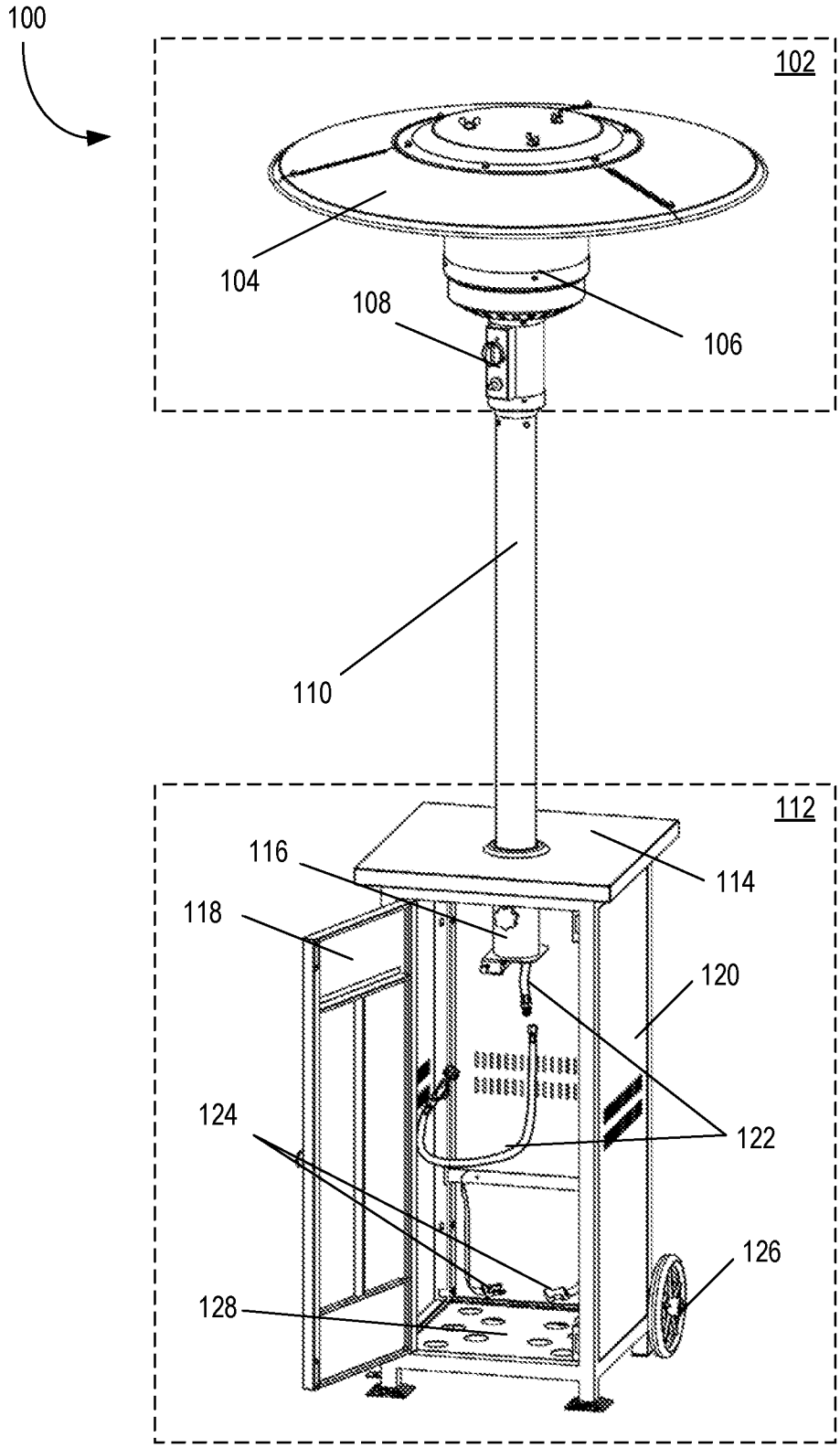
FIG. 1 illustrates a perspective view of a collapsible radiative heater assembly, according to an example embodiment of the present disclosure.

Some implementations of the disclosed technology will be described more fully with reference to the accompanying drawings. This disclosed technology may, however, be embodied in many different forms and should not be construed as limited to the implementations set forth herein. The components described hereinafter as making up various elements of the disclosed technology are intended to be illustrative and not restrictive. Many suitable components that would perform the same or similar functions as components described herein are intended to be embraced within the scope of the disclosed electronic devices and methods. Such other components not described herein may include, but are not limited to, for example, components developed after development of the disclosed technology.

It is also to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

Embodiments of the present disclosure provide a collapsible radiative heater assembly that may include a burner unit, a hollow collapsible neck and a base. The base of the collapsible radiative heater assembly may comprise a receiving device that is mounted to the base. The receiving device may be configured to receive the hollow collapsible neck of the collapsible radiative heater assembly. The receiving device may comprise of a first locking mechanism and a second locking mechanism. The first locking mechanism may further comprise of a receiving device body, a mounting plate, and a first locking mechanism. The second locking mechanism may comprise of a baseplate, a flange, a backplate, and a backstop.

Embodiments of the present disclosure provide a locking member and an attachment receptacle attached to the second locking mechanism for securing the hollow collapsible neck is disclosed. The collapsible radiative heater assembly may include a burner unit, a hollow collapsible neck and a base. The base of the collapsible radiative heater assembly may comprise a receiving device that is mounted to the base. The receiving device may be configured to receive the hollow collapsible neck of the collapsible radiative heater assembly. The receiving device may comprise of an upper portion and a second locking mechanism. The upper portion may further comprise of a receiving device body, a mounting plate, and a first locking mechanism. The second locking mechanism may comprise a baseplate, a flange, a backplate, and a backstop. The locking member and the attachment receptacle may be configured to receive the hollow collapsible neck of the collapsible radiative heater assembly.

Embodiments of the present disclosure provide a collapsible radiative heater assembly may be configured into at least two configurations, "service mode" and "storage mode." In other embodiments, the collapsible radiative heater assembly may be configured into at least three modes, "service mode", "storage mode" and "transport mode." In "service mode" described in detail later, the hollow collapsible neck is extended such that hollow collapsible neck is not in contact with the bottom plate. In "service mode", describe in detail later herein, the hollow collapsible neck is in contact with the bottom plate. In "transport mode", described in detail later, the hollow collapsible neck is in contact with the bottom plate, but additionally includes a protective casing attached to the table top of the collapsible radiative heater assembly. The protective casing including a cover, a cover attachment mechanism and a handhold.

Reference will now be made in detail to example embodiments of the disclosed technology, examples of which are illustrated in the accompanying drawings and disclosed herein. Wherever convenient, the same references numbers will be used throughout the drawings to refer to the same or like parts.

Figure 5:
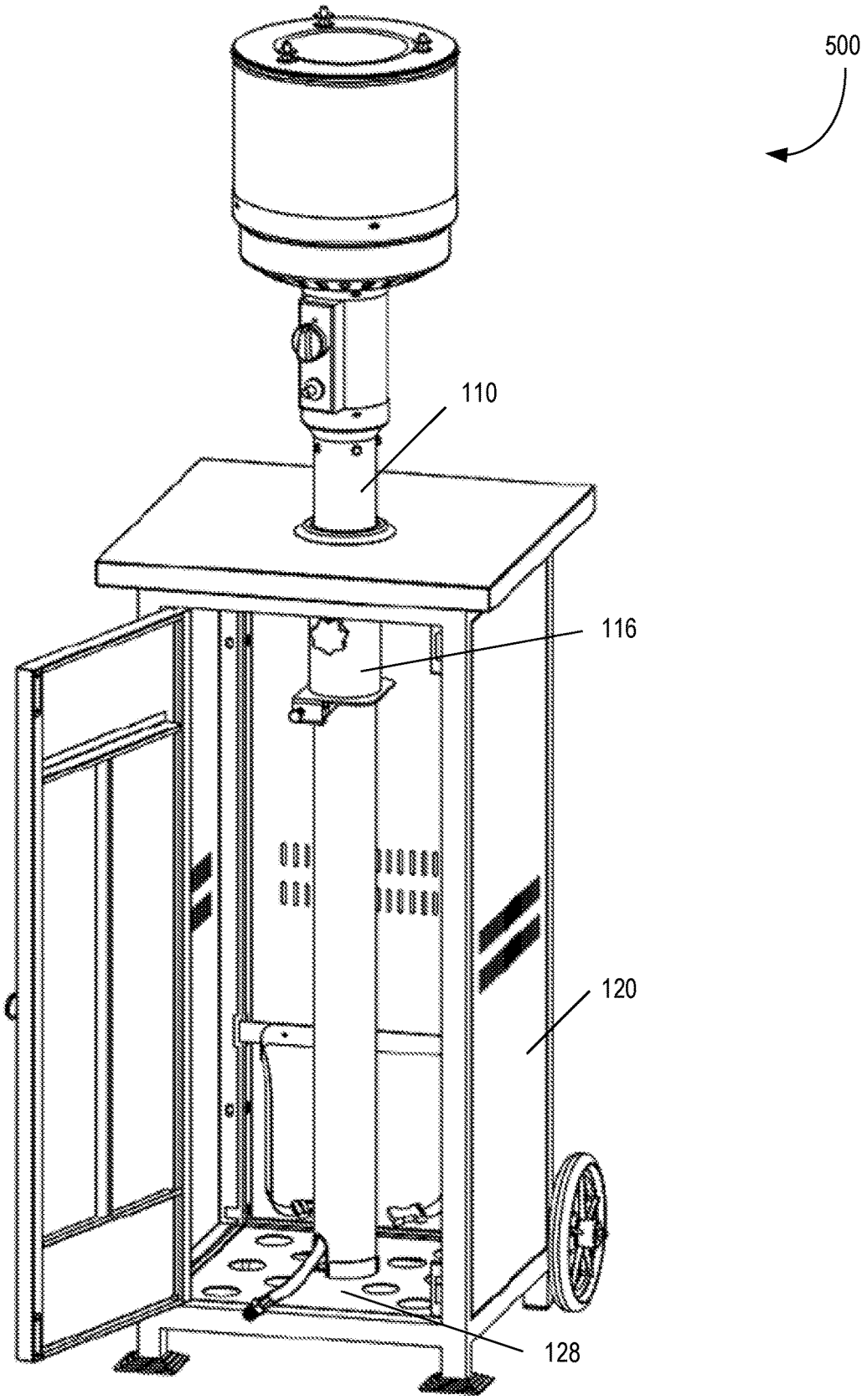
FIG. 5 illustrates a perspective view of a collapsible radiative heater assembly in a collapsed state, according to an example embodiment of the present disclosure.
Figure 6:
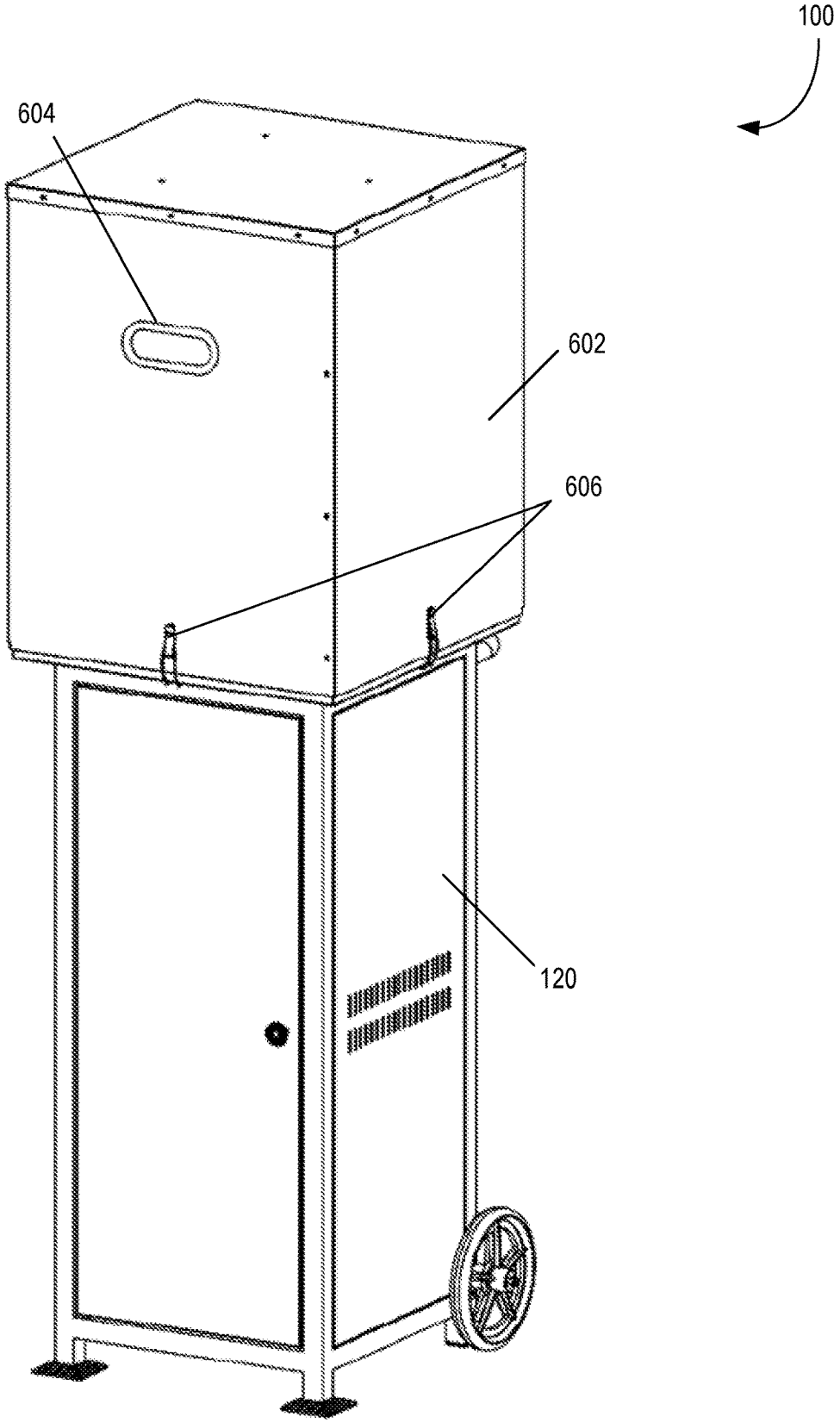
FIG. 6 illustrates a perspective view of a collapsible radiative heater assembly in a storage state, according to an example embodiment of the present disclosure.

FIG. 1 illustrates a perspective view of a collapsible radiative heater assembly 100, according to an example embodiment of the present disclosure. As shown, collapsible radiative heater assembly 100 may include a burner unit 102, a hollow collapsible neck 110, and a base 112. The burner unit 102 may include a reflector 104, a heat disbursing head 106, and an ignition system 108. The base 112, may include a table top 114, a receiving device 116, a door 118, a body 120, fuel source connection mechanism 122, a fuel source securing mechanism 124, wheels 126, and a bottom plate 128. In some embodiments, collapsible radiative heater assembly 100 may be configurable. For example, collapsible radiative heater assembly 100 may be configured in one of a service mode, as depicted in FIG. 1, a transport mode, as depicted in FIG. 5, or a storage mode, as depicted in FIG. 6.

As shown in FIG. 1, collapsible radiative heater assembly 100 is depicted in service mode, which indicates that the assembly 100 is ready for operation (e.g., ready to disburse heat generated from a fuel source through the heat disbursing head). As depicted, receiving device 116, discussed further herein, may be attached to the body 120. A bottom portion of the hollow collapsible neck 110 may be inserted into and extend from receiving device 116. The burner unit 102 may be connected to an upper portion of the hollow collapsible neck 110. Further, it will be understood by one of skill in the art that a fuel source (not shown) may be readily incorporated in the collapsible radiative heater assembly 100. Fuel sources may be reservoirs that contain fuel, for example, propane, butane, natural gas, coal, wood, biogas, batteries, or dynamos. Examples of reservoirs that contain fuel may include battery packs or propane tanks. The fuel source may be secured within the base 112 using the fuel source securing mechanism 124 and may be connected to the fuel source connection mechanism 122 allowing for fuel to leave the fuel source. Further, the fuel may be transported to the burner unit 102 from the fuel source through a fuel line such as gas lines, hoses or other mechanisms of transport connected to the fuel source connection mechanism 122 and stored within the hollow collapsible neck 110.

As depicted, base 112 may include table top 114, receiving device 116, door 118, body 120, fuel source connection mechanism 122, fuel source securing mechanism 124, wheels 126, and bottom plate 128. According to some embodiments, table top 114 may be positioned at various locations along the hollow collapsible neck 110. In some embodiments table top 114 may be adjustable to various locations through one or more locking mechanisms. Receiving device 116 may be configured to receive the hollow collapsible neck 110. In some embodiments, and as further described herein, receiving device 116 may be configured to allow the collapsible radiative heater assembly 100 to be altered from a first mode (e.g., service mode) to a second mode (e.g., storage mode). The door 118 may comprise a mechanism for securing the door 118 to the body 120, for example, a door lock with a removable key or a latch.

In some embodiments, base 112 may include lighting either inside or outside the body 120. The lighting may serve to, for example, provide decoration or ground effects for the collapsible radiative heater assembly or provide illumination to assist in the securing or connection of the fuel source to the fuel source securing mechanism 124 or the fuel source connection mechanism 122. In some embodiments, lighting may be provided by, for example, LED, laser, halogen, incandescent, or neon light sources which may emit multiple colors or may provide a monochromatic emission. Properties of the light source (i.e. color, intensity, position, orientation, switch on/off) may be synchronized with external inputs such as audio, clocks, or pre-programmed sequences. The light sources may be controlled using a controller and may respond to inputs from sensors, for example, microphone, GPS, proximity sensors or the like.

As depicted, burner unit 102 may include reflector 104, heat disbursing head 106, and ignition system 108. According to some embodiments, heat disbursing head 106 may be attached to hollow collapsible neck 110. For example, heat disbursing head 106 may be attached via an attachment device, such as pins, nuts, pegs, latches, keys, screws, threaded fasteners, snap fasteners, hook and loop fasteners, magnets, clips, clamps, or other suitable attachment device. Reflector 104 may attach to the upper portion of the heat disbursing head 106 via one or more attachment devices, such as, for example, wing nut washers. In some embodiments, the attachment device used to attach reflector 104 to heat disbursing head 106 may be capable of being hand operated. As will be appreciated, such an embodiment may allow for reduced time required to take on or take off the reflector 104. In some embodiments, ignition system 108 may be attached to the heat disbursing head 106.

The burner unit 102 may be configured to convert fuel into heat. In some embodiments, the heat disbursing head 106 may receive fuel through a fuel line such as gas lines, hoses or other mechanisms of transport stored within the hollow collapsible neck 110. Ignition system 108 may be configured to ignite the received fuel. Heat disbursing head 106 may include a venting system having one or more openings to allow for the resulting heat produced by the ignited fuel to escape the collapsible radiative heater assembly 100. Reflector 104 may be configured to direct the heat escaping the assembly 100 into one or more desired direction. For example, in some embodiments, reflector 104 may be circular and may be configured to direct the produced heat in a downward direction.

In some embodiments, ignition system 108, may comprise one or more processors, memory storing instructions, one or more thermocouple, one or more valves, one or more ignition sources, microcontrollers, wired or wireless communication interfaces, such as WiFi, Bluetooth, NFC, Ethernet, USB, Firewire, or the like, or one or more thermistors, thermopiles, RTDs, flow sensors, humidity sensors, pressure sensors, gas sensors, carbon monoxide sensors, ozone sensors and the like. For example, in some embodiments, ignition system 108 may include a display for displaying information, such as the temperature, about assembly 100.

In some embodiments, the ignition system 108 may be configured to be manually operated in order to control a mechanism to adjust the burn rate of the fuel source in order to increase or decrease the temperature of the heat being generated. For example, ignition system 108 may include a knob that a user may use to adjust the burn rate. In other embodiments, the ignition system 108 may be configured to be automatically operated in order to control a mechanism to adjust the burn rate of the fuel source in order to increase or decrease the temperature of the heat being generated. For example, ignition system 108 may include a temperature sensor and may automatically adjust the burn rate in order to generate a desired temperature. In some embodiments, ignition system 108 may be capable of sending and receiving commands wirelessly. For example, in some embodiments, ignition system 108 may be configured to communicate with other assemblies. The advantages of such a mesh network will be appreciated by one of skill in the art.

Though reflector 104, the heat disbursing head 106, the hollow collapsible neck 110 and the receiving device 116 are depicted circular or cylindrical in nature, one of skill would appreciate that such components are not so limited. In some embodiments, for example, a rhombus, a parallelogram, a rectangle, an ellipse, a sphere, a trapezoid or any combination thereof are acceptable form factors of the elements. According to some embodiments, reflector 104, heat disbursing head 106 and/or hollow collapsible neck 110 may include a handle for ease of manipulation.

Figure 2:
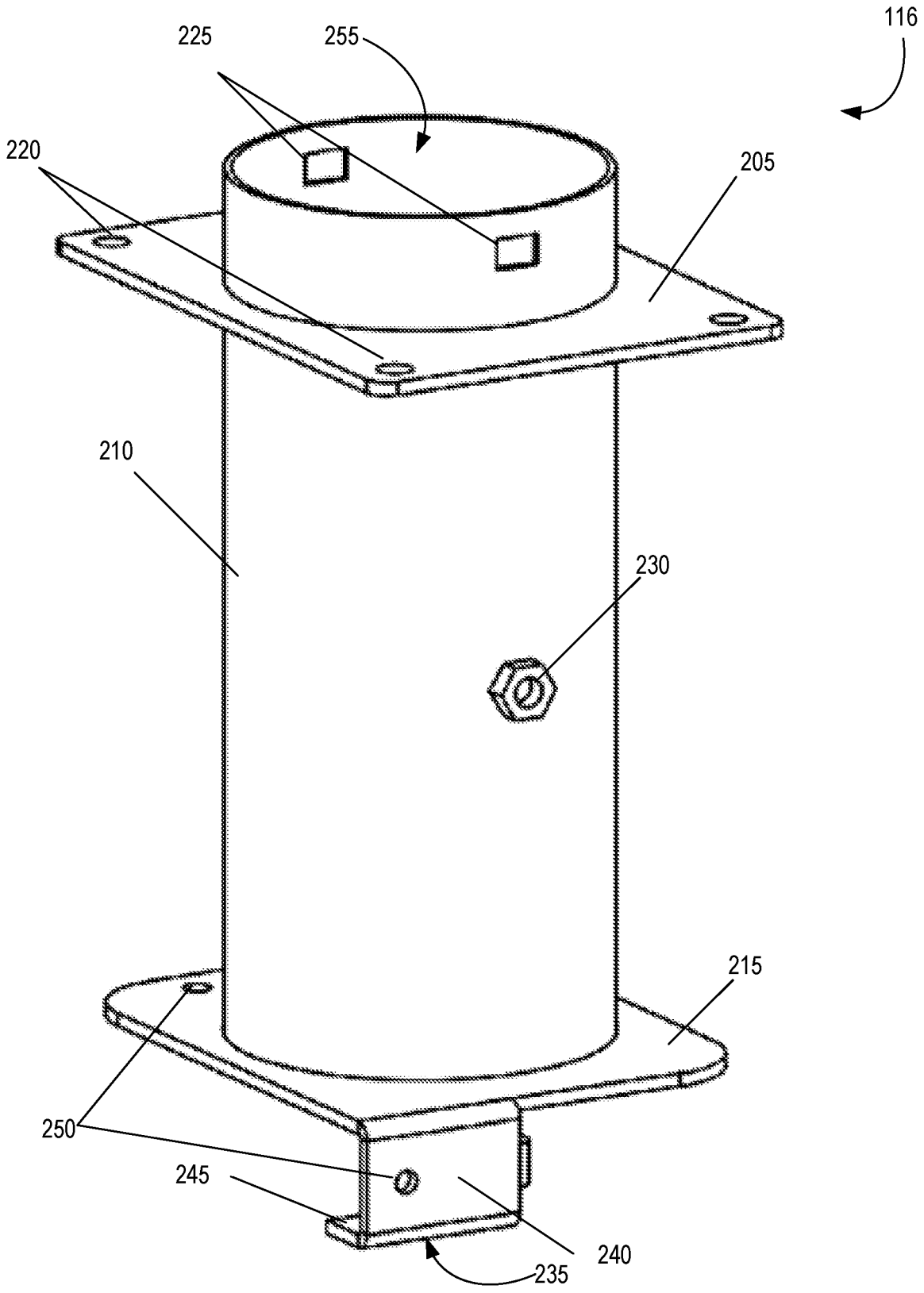
FIG. 2 illustrates a perspective view of a receiving device, according to an example embodiment of the present disclosure.

FIG. 2 illustrates a perspective view of a receiving device 116, according to an example embodiment of the present disclosure. As previously discussed, receiving device 116 may be configured to receive the hollow collapsible neck 110. Further, receiving device 116 may be configured to allow the collapsible radiative heater assembly 100 to be altered from a first mode (e.g., service mode) to a second mode (e.g., storage mode) by allowing the hollow collapsible neck 110 to move from a first vertical position to a second vertical position (e.g., lower to higher or vice versa). As depicted, receiving device 116 may comprise a mounting plate 205, a body 210, a baseplate 215, and a receiving portion 255. Mounting plate 205 may comprise one or more mounting mechanisms 220. Body 210 may comprise one or more post securing mechanisms 225 and a first locking mechanism 230. Baseplate 215 may comprise a second locking mechanism 235 which may include a backstop 240, a flange 245, and one or more locking mechanism securing portions 250.

In some embodiments, mounting plate 205 may be configured to mount to body 120 of base 112. For example, in some embodiments, mounting plate may attach to the body 120 via one or more mounting mechanisms 220. In some embodiments, mounting mechanisms 220 may comprise one or more of: pins, nuts, pegs, latches, keys, screws, threaded fasteners, snap fasteners, slots, hook and loop fasteners, magnets, clips, clamps, or other suitable attachment devices. The receiving portion 255 may be configured to receiving hollow collapsible neck 110. In some embodiments, receiving portion 255 may include features, for example, grooves, slots, guides or pins that may help align or guide the hollow collapsible neck 110 as it is inserted into the receivable device 116. For example, receiving portion may be a hollow portion of the receiving device body 210 with a diameter greater than the diameter of the hollow collapsible neck 110. Once the hollow collapsible neck 110 is received by the receiving portion 255, the first locking mechanism 230 may be configured to lock the vertical position of the hollow collapsible neck 110. For example, the first locking mechanism 230 may comprise an aperture in the receiving device body 210 and a corresponding securing device, such as for example, a screw or other fastener. In such an embodiment, the securing device may be inserted into the aperture and against the hollow collapsible neck 110 to prevent neck 110 from any further vertical movement.

In some embodiments, baseplate 215 of receiving device 116 may include second locking mechanism 235. Second locking mechanism 235 may also be configured to lock the vertical position of the hollow collapsible neck 110 and may comprise backstop 240, a flange 245, and one or more locking mechanism securing portions 250. Once the hollow collapsible neck 110 is received by the receiving portion 255, the second locking mechanism 2305 may be configured to lock the vertical position of the hollow collapsible neck 110 by preventing hollow collapsible neck 110 from moving downward past the second locking mechanism 235. For example, second locking mechanism 235 may include a locking member (not pictured), discussed further herein, configured at attach to baseplate 215 and be received by backstop 240 and 245 such that the locking member covers at least a portion of the bottom of receiving device 116, thus preventing the hollow collapsible neck 110 from moving downward.

As will be appreciated by one of skill, the receiving device 116 provides the assembly 100 with the advantage of being able being able to vertically move the neck 110 and burner unit 102 depending on the needs of a user (e.g., up for operation, down for maintenance, in between for various other purposes.

Figure 3B:
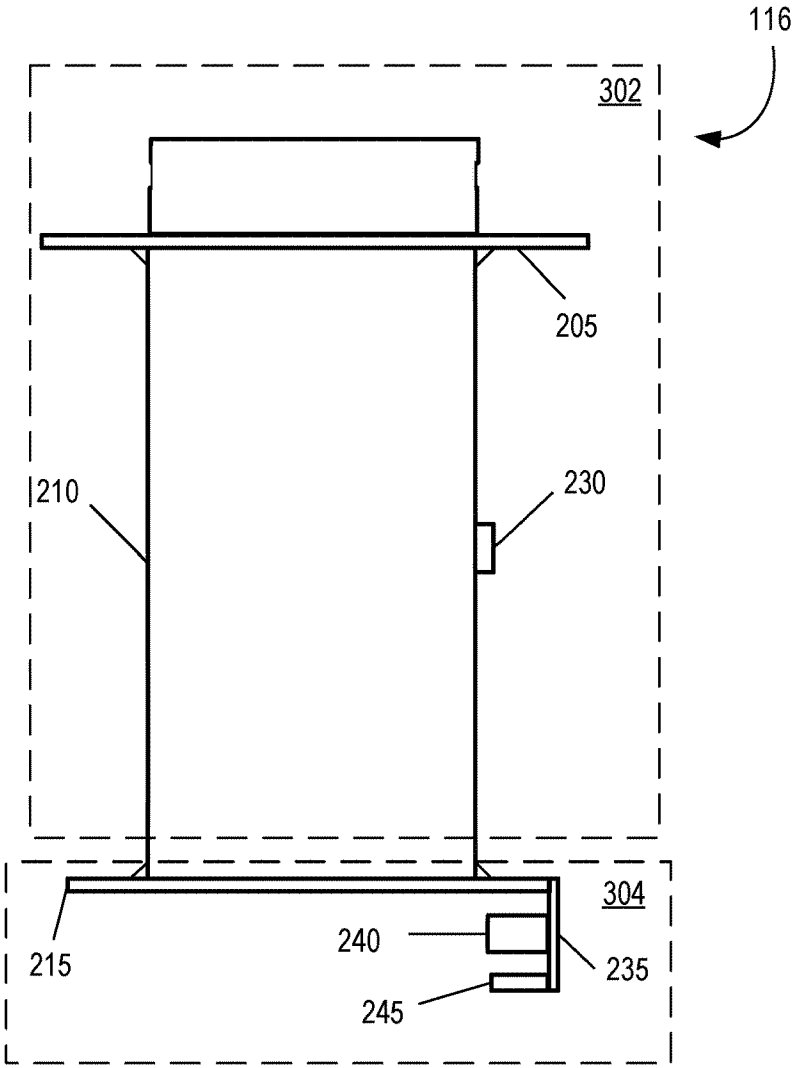
FIGS. 3A and 3B illustrate schematic views of a receiving device, according to an example embodiment of the present disclosure.
Figure 3A:
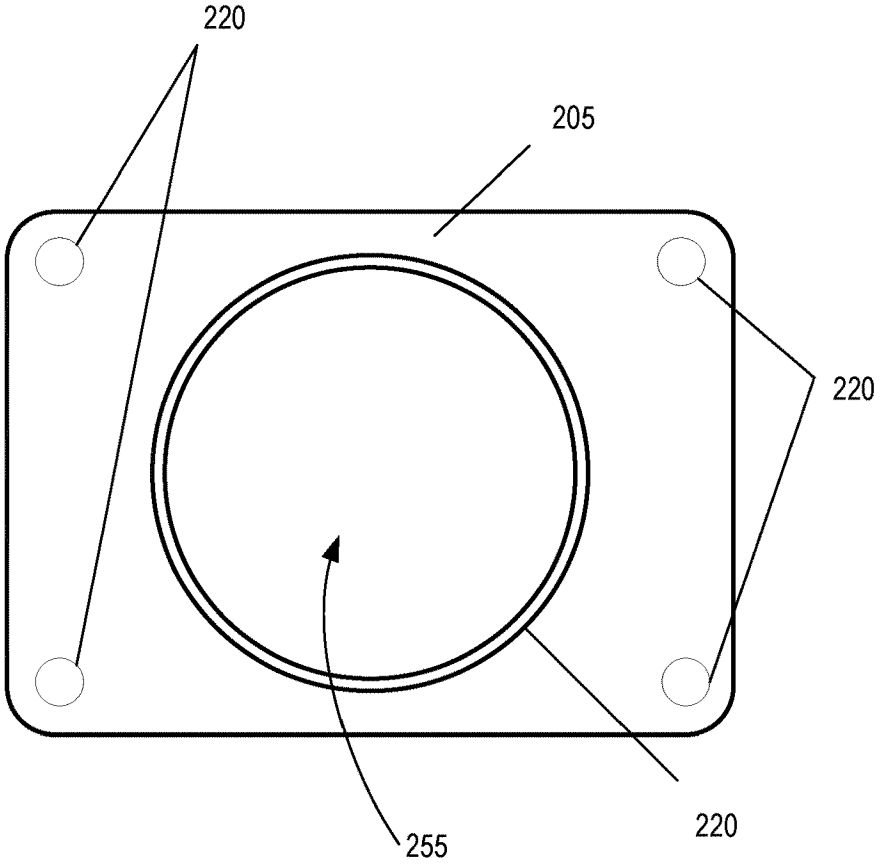

FIGS. 3A and 3B illustrate schematic views of a receiving device 116, according to an example embodiment of the present disclosure. FIG. 3A illustrates a top-down view of the example embodiment of the receiving device 116, while FIG. 3B illustrates a side view of the receiving device 116. As depicted, receiving device 116 may comprise an upper portion 302 and lower portion 304. In some embodiments, receiving device 116 may be constructed out of one material or several materials. The materials may include, for example, one or more of: aluminum, steel, stainless steel, iron, wood, wax, bamboo, foam, cellulose fibers, PVC, PET, glass, acrylic, rubber, ceramics, fiberglass, carbon fiber, clay, concrete, cement, terra cotta, phosphorescent materials, bricks, stones, or aerogel. Further, receiving device 116 or portions of the receiving device 116 may include surface finishes or coatings, for example, but are not limited to: waterproofing coatings, sealants, anti-corrosion coatings, anti-reflective coatings, insulating coatings, conformal coatings, anti-scratch coatings, magnetic coatings, anti-fouling coatings, fragrance coatings, anti-friction coatings, fire protective coatings, tints or reflective coatings.

Figure 4A:
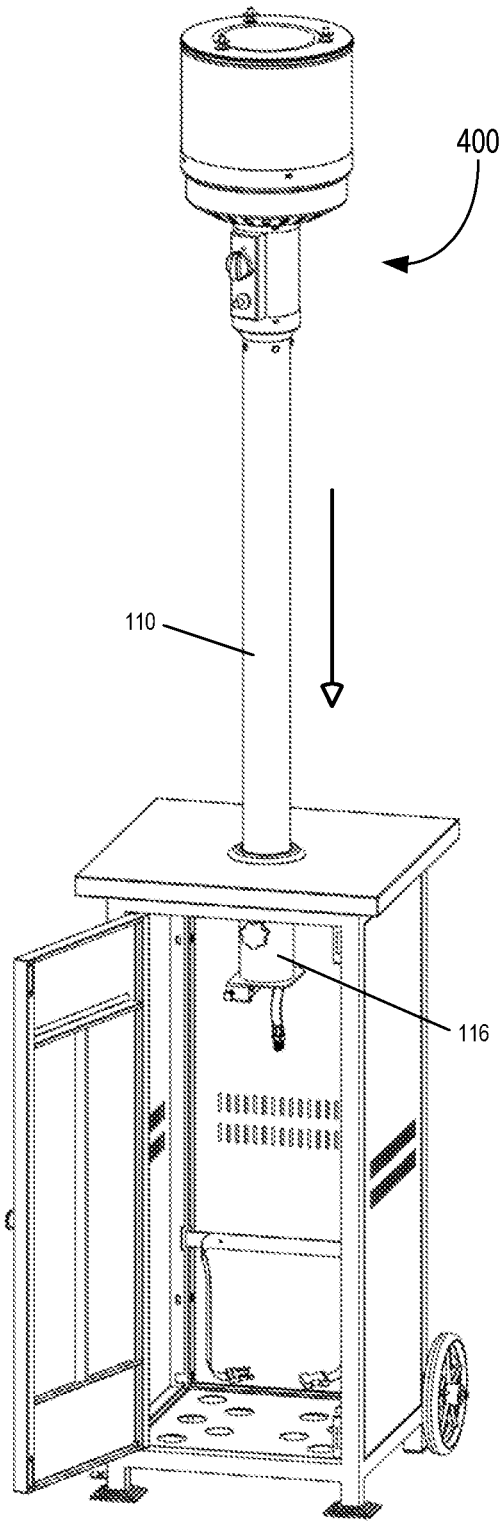
FIG. 4A illustrates a perspective view of a collapsible radiative heater assembly, according to an example embodiment of the present disclosure.

FIG. 4A illustrates a perspective view of a collapsible radiative heater assembly 140, according to an example embodiment of the present disclosure. As depicted, collapsible radiative heater assembly 400 may be in an intermediary stage between service mode, as shown in FIG. 1, and storage mode, as shown in FIG. 5. In such a stage, reflector 104 and fuel source may be removed and the fuel source from assembly 400. For example, fuel source may be detached from fuel source attachment mechanism 122 and reflector 104 may be detached from heat disbursing head 106. In some embodiments, hollow collapsible neck 110 may be lowered from a first vertical height to a second lower vertical height before the reflector 104 may be detached. For example, first and second locking mechanisms 230, 235 may be unlocked such that hollow collapsible neck 110 may be vertically lowered through the receiving device 116 into the body 120 of the base 112. As will be appreciated, such an embodiment may allow for easier disassembly of the burner unit 102. According to some embodiments, body 120 of base 112, may include provisions to accommodate the removed reflector 104. Provisions may include, for example, one or more of: pins, nuts, pegs, latches, keys, screws, threaded fasteners, snap fasteners, slots, hook and loop fasteners, magnets, clips, clamps, hinges, or ball and socket joints to secure the reflector 104 to the base 112.

Figure 4B:
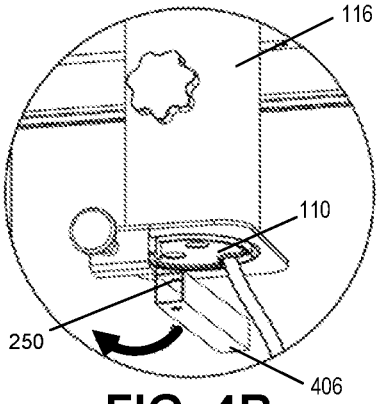
FIGS. 4B and 4C illustrate zoomed in views of the receiving device from FIG. 4A in open and locked positions, according to example embodiments of the present disclosure.
Figure 4C:
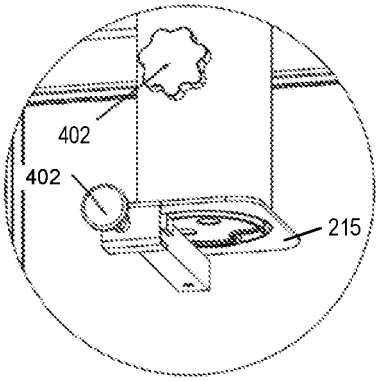

FIGS. 4B and 4C illustrate magnified views of the receiving device 116 from FIG. 4A in open (FIG. 4B) and locked (FIG. 4C) positions, according to example embodiments of the present disclosure. As shown, the first and second locking mechanisms 230, 235, may include post hold fasteners 402. Further, second locking mechanism 235 may include a locking member 406. In some embodiments, the locking member 406 may be attached to the bottom plate 215 of the securing device 116 via one or more locking mechanism securing portions 250. In some embodiments, the locking member 406 may be configured to swivel about any axis with respect to the one or more locking mechanism securing portions 250. For example, locking member 406 may be configured to swivel radially from a first open position, as depicted in FIG. 4B, to a second locked position, as depicted in FIG. 4C.

According to some embodiments, collapsible radiative heater assembly 400 may be configured into storage mode from service mode by unfastening the post hold fastener 402 associated with the first and second locking mechanisms 230, 235. Then swiveling the locking member 406 approximately 180 degrees, thus allowing the hollow collapsible neck 110, to slide through receiving device 116 until it rests on the bottom plate 128 of the base 112. As will be appreciated, in some embodiments, the system may have more or less locking mechanism. In such embodiments, each would need to be disengaged before such changes in mode can occur.

FIG. 5 illustrates a perspective view of a collapsible radiative heater assembly 500 in a collapsed state, or storage mode, according to an example embodiment of the present disclosure. As depicted, reflector 104 and fuel source may be removed and the fuel source from assembly 500. Further, collapsible hollow neck 110 may be inserted into through receiving device 116 and may rest against the bottom plate 128 of the base 112. As will be appreciated, such an embodiment provides the benefit of being having an assembly 500 capable of being stored more easily and efficiently.

FIG. 6 illustrates a perspective view of a collapsible radiative heater assembly 100 in a storage state, or transport mode, according to an example embodiment of the present disclosure. As depicted, collapsible radiative heater assembly 100 may comprise a protective cover 602 having a handhold 604 and one or more cover attachment mechanism 606. While collapsible radiative heater assembly 100 is in storage state, as depicted and described above with reference to FIG. 5, protective cover 602 may attach via one or more cover attachment mechanism 606 to body 120 of base 112. In some embodiments, cover attachment mechanisms 606 may include, for example, one or more of: pins, nuts, pegs, latches, keys, screws, threaded fasteners, snap fasteners, slots, hook and loop fasteners, magnets, clips, clamps, hinges, or ball joints. Further, it would be appreciated that the one or more handholds 606, may also include, for example, one or more of: handles, lever arms, perforations, knobs, rings, hooks or the like.

One of skill in the art would understand that the protective casing 602, may be large enough to accommodate the reflector 104, that may be attached to the heat disbursing head 106. In embodiments, the reflector 104 is not attached to the heat disbursing head 106, and the protective casing 602 may have at least one dimension smaller than the reflector 104. In some embodiments, cover 602 may be constructed out of one or more materials which may include, for example, one or more of: aluminum, steel, stainless steel, iron, wood, wax, bamboo, foam, cellulose fibers, PVC, PET, glass, acrylic, rubber, ceramics, fiberglass, carbon fiber, clay, concrete, cement, terra cotta, phosphorescent materials, bricks, stones, or aerogel. Further, cover 602 or portions of the cover 602 may include surface finishes or coatings, for example, but are not limited to: waterproofing coatings, sealants, anti-corrosion coatings, anti-reflective coatings, insulating coatings, conformal coatings, anti-scratch coatings, magnetic coatings, anti-fouling coatings, fragrance coatings, anti-friction coatings, fire protective coatings, tints or reflective coatings.

According to some example embodiments, once the collapsible radiative heater assembly 100 is in "storage mode" with the reflector 104 unattached to the heat disbursing head 106, a protective casing 602 may be placed over the table top 114 using handholds 604, covering the ignition system 108 and the heat disbursing head 106. The cover 602, may be secured to the table top 114, by securing the cover attachment mechanism 606 to the table top 114. The cover attachment mechanism 606 may be attached to the cover 602. Alternatively, the cover attachment mechanism 606 may be attached to the table top 114. In some embodiments, cover 602, may be secured to the base 112, by securing the cover attachment mechanism 06 to the base 112. As will be appreciated, such an embodiment provides the benefit of being having a radiative heater assembly 100 having increased durability.

Figure 7:
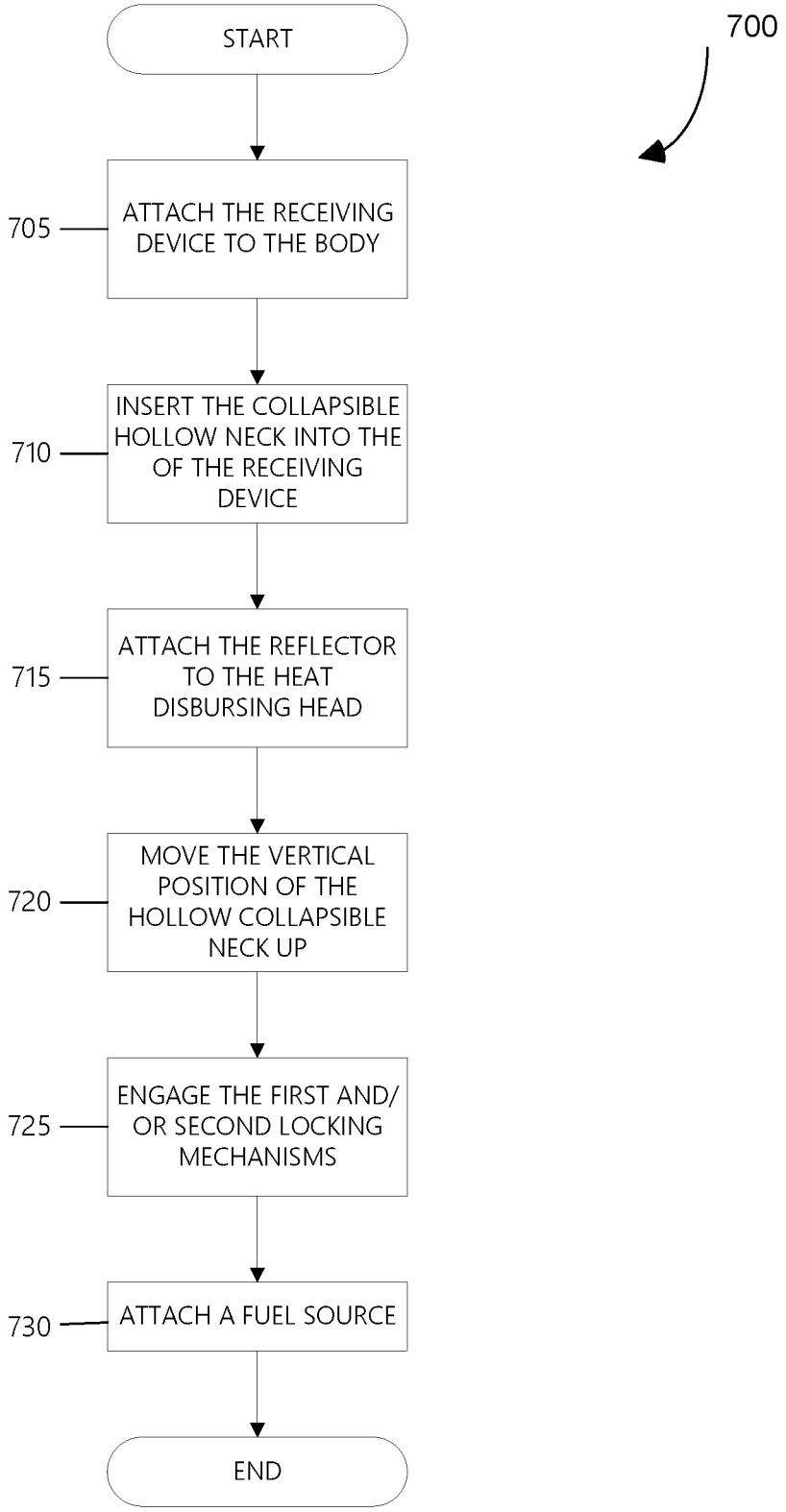
FIG. 7 illustrates a method for assembling a collapsible radiative heater assembly, according to an example embodiment of the present disclosure.

FIG. 7 illustrates a method 700, for assembling the collapsible radiative heater assembly 100. At block 705, the receiving device 116, may be attached to the body 120 of the base 112. For example, mounting plate 205 of receiving device 116 may be attached to an upper surface of the body 120 via one or more mounting mechanisms 220. In some embodiments, receiving device 116 may be an integral part of body 120, such that no independent attachment is required.

At block 710, the collapsible hollow neck 110 may be inserted into receiving device 116. For example, in some embodiments, collapsible hollow neck 110 may be inserted into a receiving portion 255 of receiving device 116 such that the collapsible hollow neck 110 may contact the bottom plate 128 of the base 112. In some embodiments, receiving portion 255 may include features, for example, grooves, slots, guides or pins that may help align or guide the hollow collapsible neck 110 as it is inserted into the receivable device 116. For example, receiving portion may be a hollow portion of the receiving device body 210 with a diameter greater than the diameter of the hollow collapsible neck 110.

At block 715, the reflector 104 may be attached to the heat disbursing head 106. For example, the reflector may attach to the upper portion of the heat disbursing head 106 via one or more attachment devices, such as, for example, wing nut washers. In order to attach reflector 104, such attachment devices may be secured.

At block 720, the hollow collapsible neck 110 may be moved from a first lower vertical position to a second higher vertical position. For example, neck 110 may be raised up through receiving device 116 to a desired height, such that neck 110 is no longer in contact with bottom plate 128. In some embodiments, neck 110 may be raised up to a height that would allow for a fuel source, may be secured and connected within the base 112.

At block 725, at least one of the first locking mechanism 230 or the second locking mechanism 235 may be engaged such that the vertical position of the hollow collapsible neck 110 may be securely fixed relative to the receiving device 116. In some embodiments, hollow collapsible neck 110 may be fully extended such that both the first and second locking mechanisms 230,235 may both be engaged.

At block 730, the fuel source may be attached. For example, fuel source may be secured to the base 112 using a fuel source securing mechanism 124. Further, the fuel source may be attached to a fuel source connection mechanism 122.

Figure 8:
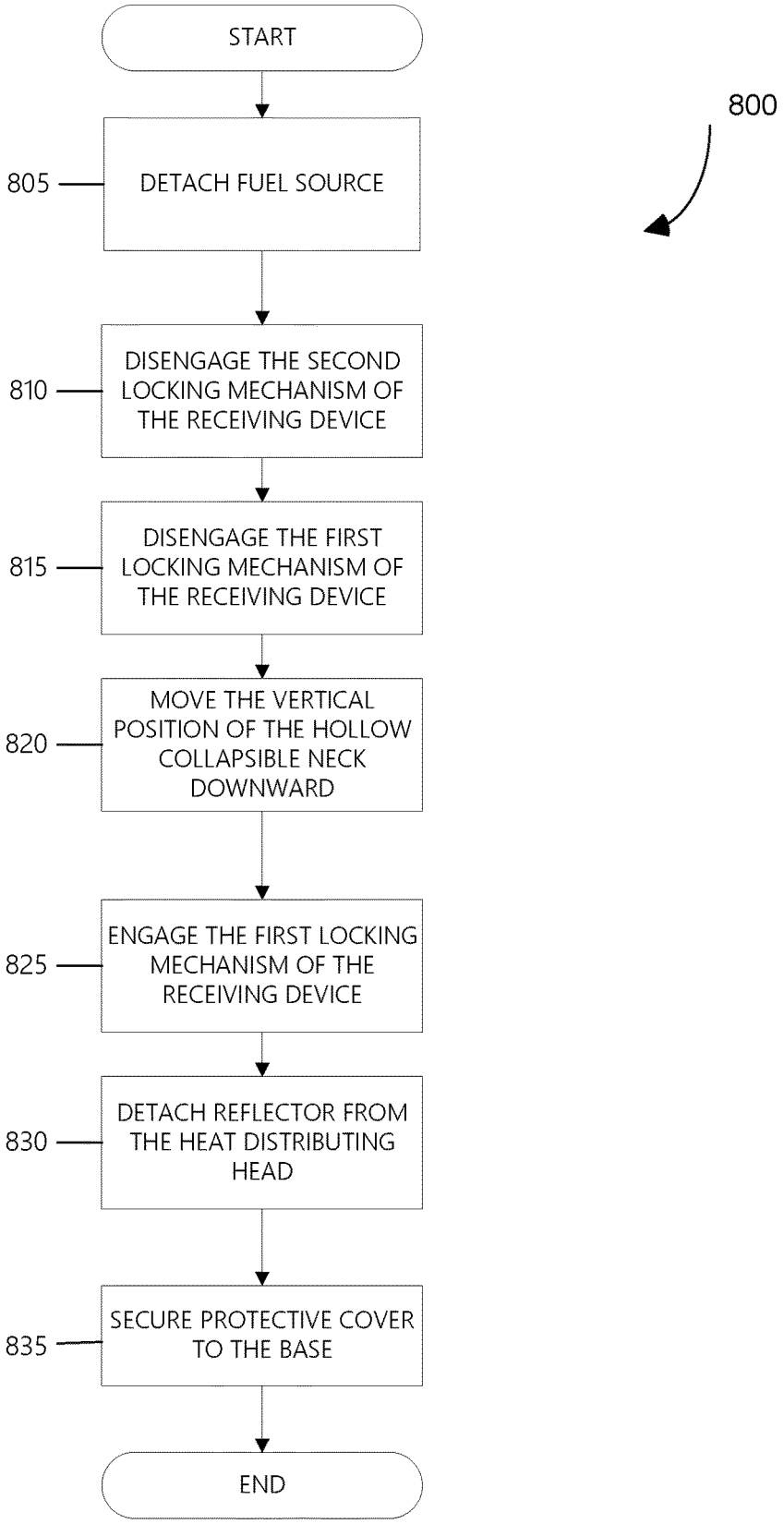
FIG. 8 illustrates a method for collapsing a collapsible radiative heater assembly, according to an example embodiment of the present disclosure.

FIG. 8 illustrates a method 800 for collapsing a collapsible radiative heater assembly 100, according to an example embodiment of the present disclosure. At block 805, the fuel source may be detached from the assembly 100. For example, fuel source may be removed from the base 112 by detaching fuel source securing mechanism 124 and fuel source connection mechanism 122.

At block 810, the second locking mechanism 235 may be disengaged. For example, in some embodiments, locking member 406 may be rotated such that it is no longer in a locked position. At block 815, the first locking mechanism 230 may be disengaged. For example, in some embodiments, a screw or fastener may be removed an aperture in the receiving device body 210.

At block 820, the vertical position of the hollow collapsible neck 110 may be manipulated such that the first end of the hollow collapsible neck 110 is in contact with the bottom plate 128. For example, in some embodiments, upon disengagement of the locking mechanisms 230, 235, the hollow collapsible neck 110 may slide through receiving device 116 until it rests on the bottom plate 128 of the base 112.

At block 825, the first locking mechanism 208 may be engaged to affix the manipulated vertical position of the hollow collapsible neck 110. The first locking mechanism 208 may be engaged automatically based on, for example, the vertical position of the hollow collapsible neck as determined by electronic or mechanical sensors. Alternately, the first locking mechanism 208 may be engaged by manual means.

At block 830, the reflector 104, may be detached from the heat disbursing head 106. For example, the reflector may detach from the upper portion of the heat disbursing head 106 via one or more attachment devices, such as, for example, wing nut washers. In order to detach reflector 104, such attachment devices may be removed.

At block 835, the protective casing or cove 602, may be attached to the body 120 of the base 112. In some embodiments, cover 602, may be secured to the base 112, by securing the cover attachment mechanism 606 to the base 112. According to some embodiments, cover attachment mechanisms 606 may be attached to the cover 606. In some embodiments, the cover attachment mechanisms 606 may be attached to the base 112.

Figure 9:
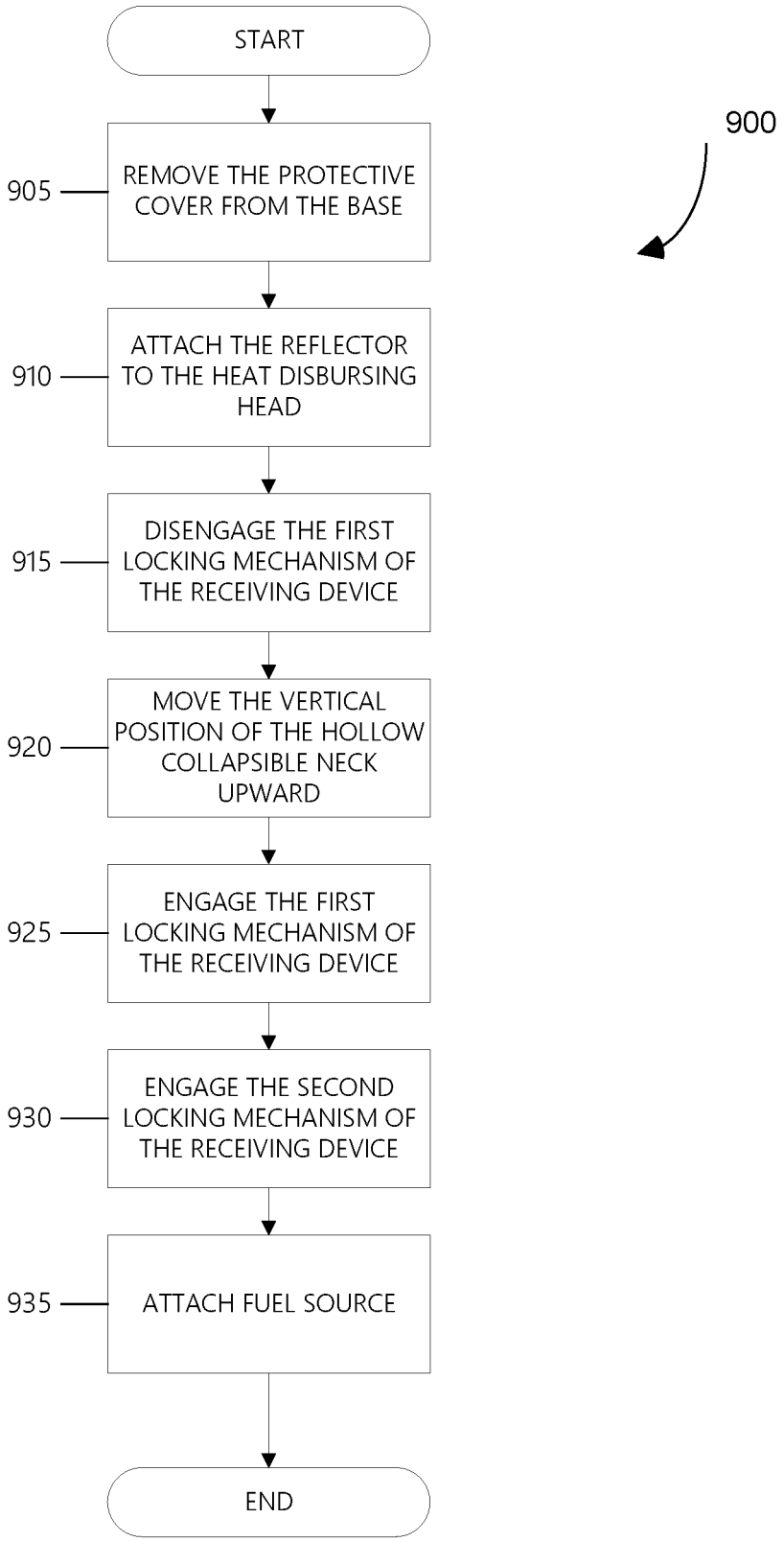
FIG. 9 illustrates a method for erecting a collapsible radiative heater assembly, according to an example embodiment of the present disclosure.

FIG. 9 illustrates a method 900 for erecting a collapsible radiative heater assembly 100, according to an example embodiment of the present disclosure. At block 905, the protective casing 602 may be removed from the base 112. For example, in some embodiments, cover attachment mechanisms 606 may be disengaged and the cover may be removed from the base 112. In some embodiments, cover 602 may be removed with the assistance of one or more handholds 604.

At block 910, the reflector 104 may be attached to the heat disbursing head 106. For example, the reflector may attach to the upper portion of the heat disbursing head 106 via one or more attachment devices, such as, for example, wing nut washers. In order to attach reflector 104, such attachment devices may be secured.

At block 915, the first locking mechanism 230 may be disengaged. For example, in some embodiments, a screw or fastener may be removed an aperture in the receiving device body 210.

At block 920, the hollow collapsible neck 110 may be moved from a first lower vertical position to a second higher vertical position. For example, neck 110 may be raised up through receiving device 116 to a desired height, such that neck 110 is no longer in contact with bottom plate 128. In some embodiments, neck 110 may be raised up to a height that would allow for a fuel source, may be secured and connected within the base 112.

At block 925, the first locking mechanism 208 may be engaged to affix the manipulated vertical position of the hollow collapsible neck 110. The first locking mechanism 208 may be engaged automatically based on, for example, the vertical position of the hollow collapsible neck as determined by electronic or mechanical sensors. Alternately, the first locking mechanism 208 may be engaged by manual means.

At block 930, the second locking mechanism 210 may be engaged. Engaging the second locking mechanism 210 may constrain the hollow collapsible neck 110, such that the first end of the hollow collapsible neck 110 may not be positioned lower than the second locking mechanism 210.

At block 935, the fuel source may be attached. For example, fuel source may be secured to the base 112 using a fuel source securing mechanism 124. Further, the fuel source may be attached to a fuel source connection mechanism 122.

Certain embodiments and implementations of the disclosed technology are described above with reference to block and flow diagrams of systems and methods according to example embodiments or implementations of the disclosed technology. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams may not necessarily need to be performed in the order presented, may be repeated, or may not necessarily need to be performed at all, according to some embodiments or implementations of the disclosed technology.

In this description, numerous specific details have been set forth. It is to be understood, however, that implementations of the disclosed technology may be practiced without these specific details. In other instances, well-known methods, structures and techniques have not been shown in detail in order not to obscure an understanding of this description. References to "one embodiment," "an embodiment," "some embodiments," "example embodiment," "various embodiments," "one implementation," "an implementation," "example implementation," "various implementations," "some implementations," etc., indicate that the implementation(s) of the disclosed technology so described may include a particular feature, structure, or characteristic, but not every implementation necessarily includes the particular feature, structure, or characteristic. Further, repeated use of the phrase "in one implementation" does not necessarily refer to the same implementation, although it may.

Throughout the specification and the claims, the following terms take at least the meanings explicitly associated herein, unless the context clearly dictates otherwise. The term "connected" means that one function, feature, structure, or characteristic is directly joined to or in communication with another function, feature, structure, or characteristic. The term "coupled" means that one function, feature, structure, or characteristic is directly or indirectly joined to or in communication with another function, feature, structure, or characteristic. The term "or" is intended to mean an inclusive "or." Further, the terms "a," "an," and "the" are intended to mean one or more unless specified otherwise or clear from the context to be directed to a singular form. By "comprising" or "containing" or "including" is meant that at least the named element, or method step is present in article or method, but does not exclude the presence of other elements or method steps, even if the other such elements or method steps have the same function as what is named.

As used herein, unless otherwise specified the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

While certain embodiments of this disclosure have been described in connection with what is presently considered to be the most practical and various embodiments, it is to be understood that this disclosure is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the technology and also to enable any person skilled in the art to practice certain embodiments of this technology, including making and using any apparatuses or systems and performing any incorporated methods. The patentable scope of certain embodiments of the technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A collapsible radiative heater assembly, comprising:

a base comprising:

a body having an upper surface and a cavity configured to receive a fuel source, and a receiving device attached to the upper surface comprising a receiving portion and first and second locking mechanisms;

a hollow collapsible neck for transporting fuel from the fuel source having a first end insertable into the receivable portion of the receiving device and a second end, the hollow collapsible neck being configured to move about a central vertical axis of the receiving device, wherein the first and second locking mechanism are configured such that when engaged they coordinate to secure and maintain a vertical position of the hollow collapsible neck and when disengaged the vertical position of the hollow collapsible neck can be changed, wherein the first locking mechanism is configured to provide upward vertical support to the bottom of the hollow collapsible neck and the second locking mechanism is configured to provide lateral support to the side of the hollow collapsible neck, and wherein the engagement and disengagement of the first and second locking mechanisms is independent of the rotational alignment of the hollow collapsible neck relative the base.

2. The collapsible radiative heater assembly of claim 1, further comprising:

a heat disbursing head for generating heat mounted to the second end of the collapsible neck; and a reflector detachably mounted to the heat disbursing head.

3. The collapsible radiative heater assembly of claim 2, further comprising a cover configured to secure to the base when the reflector is detached from the heat disbursing head and when the hollow collapsible neck is fully inserted into the receiving device.

4. The collapsible radiative heater assembly of claim 2, wherein the base further comprises:

a fuel source securing mechanism configured to secure the fuel source to the base; and a fuel source connection mechanism for connecting the fuel source to the collapsible radiative heater assembly.

5. The collapsible radiative heater assembly of claim 4, wherein the hollow collapsible neck comprises a fuel line for connecting the fuel source connection mechanism with the heat disbursing head.

6. The collapsible radiative heater assembly of claim 5, wherein the fuel source is a propane tank and the fuel line is a gas line.

7. The collapsible radiative heater assembly of claim 1, wherein the heat disbursing head comprises an ignition system configured to ignite fuel from the fuel source for generating heat.

8. The collapsible radiative heater assembly of claim 1, wherein the base further comprises:

one or more wheels attached to the body, and a handle attached to the body.

9. The collapsible radiative heater assembly of claim 1, wherein the receiving portion of the receiving device is located about a central axis of the base.

10. The collapsible radiative heater assembly of claim 1, wherein at least one of the first and second locking mechanisms comprises a spring-loaded locking mechanism.

11. The collapsible radiative heater assembly of claim 10, wherein the hollow collapsible neck comprises an aperture and at least one of the first and second locking mechanisms comprises a fastener configured to be inserted into the aperture of the hollow collapsible neck.

12. A collapsible radiative heater assembly comprising:

a base comprising:

a body having an upper surface and a cavity configured to receive a fuel source, and a receiving device attached to the upper surface comprising a receiving portion and first and second locking mechanisms;

a hollow collapsible neck for transporting fuel from the fuel source, the hollow collapsible neck (i) being configured to move about a central vertical axis of the receiving device and (ii) comprising:

a first end insertable into the receivable portion of the receiving device, a second end, a table top secured around the hollow collapsible neck between the first and second ends, securable to the base, and comprising an attachment device;

a heat disbursing head for generating heat mounted to the second end of the collapsible neck; and a reflector detachably mounted to the heat disbursing head;

wherein the first and second locking mechanism are configured such that when engaged they coordinate to secure and maintain a vertical position of the hollow collapsible neck and when disengaged the vertical position of the hollow collapsible neck can be changed, wherein the first locking mechanism is configured to provide upward vertical support to the bottom of the hollow collapsible neck and the second locking mechanism is configured to provide lateral support to the side of the hollow collapsible neck, and wherein the engagement and disengagement of the first and second locking mechanisms is independent of the rotational alignment of the hollow collapsible neck relative the base.

13. The collapsible radiative heater assembly of claim 12, further comprising:

a protective cover configured to secure to the attachment device of the table top, wherein the cover is configured to slide over the heat disbursing head and attach to the attachment device when the reflector is detached from the heat disbursing head and when the hollow collapsible neck is fully inserted into the receiving device.

14. The collapsible radiative heater assembly of claim 12, wherein the base further comprises:

one or more wheels attached to the body, and a handle attached to the body.

15. The collapsible radiative heater assembly of claim 12, wherein the base further comprises:

a fuel source securing mechanism configured to secure the fuel source to the base; and a fuel source connection mechanism for connecting the fuel source to the collapsible radiative heater assembly.

16. The collapsible radiative heater assembly of claim 15, wherein the hollow collapsible neck comprises a fuel line for connecting the fuel source connection mechanism with the heat disbursing head, and wherein the fuel source is a propane tank and the fuel line is a gas line.

17. The collapsible radiative heater assembly of claim 12, wherein the receiving portion of the receiving device is located about a central axis of the base.

18. The collapsible radiative heater assembly of claim 12, wherein at least one of the first and second locking mechanisms comprises a spring-loaded locking mechanism.

19. The collapsible radiative heater assembly of claim 18, wherein the hollow collapsible neck comprises an aperture and at least one of the first and second locking mechanisms comprises a fastener configured to be inserted into the aperture of the hollow collapsible neck.

20. A collapsible radiative heater assembly comprising:

a base comprising:

a body having an upper surface and a cavity configured to receive a fuel source, a receiving device attached to the upper surface comprising a receiving portion and first and second locking mechanisms, and a cover attachment device;

a hollow collapsible neck for transporting fuel from the fuel source, the hollow collapsible neck (i) being configured to move about a central vertical axis of the receiving device and (ii) comprising:

a first end insertable into the receivable portion of the receiving device, a second end, a table top secured around the hollow collapsible neck between the first and second ends and securable to the base;

a heat disbursing head for generating heat mounted to the second end of the collapsible neck; and a reflector detachably mounted to the heat disbursing head;

wherein the first and second locking mechanism are configured such that when engaged they coordinate to secure and maintain a vertical position of the hollow collapsible neck and when disengaged the vertical position of the hollow neck can be changed, wherein the first locking mechanism is configured to provide upward vertical support to the bottom of the hollow collapsible neck and the second locking mechanism is configured to provide lateral support to the side of the hollow collapsible neck, and wherein the engagement and disengagement of the first and second locking mechanisms is independent of the rotational alignment of the hollow collapsible neck relative the base.

* * * * *